US006464829B1

(12) United States Patent
Chen et al.

(10) Patent No.: US 6,464,829 B1
(45) Date of Patent: Oct. 15, 2002

(54) TISSUE WITH SURFACES HAVING ELEVATED REGIONS

(75) Inventors: Patrick P. Chen; Wen Schroeder, both of Appleton; Mark A. Burazin, Oshkosh, all of WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/641,355

(22) Filed: Aug. 17, 2000

(51) Int. Cl.[7] ..... D21F 11/00
(52) U.S. Cl. ..... 162/109; 162/116; 162/117
(58) Field of Search ..... 162/109, 111, 162/112, 113, 116, 117

(56) References Cited

U.S. PATENT DOCUMENTS

| | | | | |
|---|---|---|---|---|
| 1,901,049 | A | | 3/1933 | Von Heinrich |
| 4,482,429 | A | | 11/1984 | Klowak |
| 4,529,480 | A | | 7/1985 | Trokham |
| 5,048,589 | A | | 9/1991 | Cook et al. |
| 5,200,037 | A | | 4/1993 | Noda |
| 5,277,761 | A | | 1/1994 | Van Phan et al. |
| 5,366,785 | A | | 11/1994 | Sawdai |
| 5,399,412 | A | | 3/1995 | Sudall et al. |
| 5,443,691 | A | | 8/1995 | Phan et al. |
| 5,510,001 | A | | 4/1996 | Hermans et al. |
| 5,556,509 | A | | 9/1996 | Trokhan et al. |
| 5,591,309 | A | | 1/1997 | Rugowski et al. |
| 5,637,194 | A | | 6/1997 | Ampulshi et al. |
| 5,654,076 | A | | 8/1997 | Trokhan et al. |
| 5,667,636 | A | | 9/1997 | Engel et al. |
| 5,714,041 | A | | 2/1998 | Ayers et al. |
| 5,766,416 | A | | 6/1998 | Hiyoshi et al. |
| 5,779,965 | A | | 7/1998 | Beuther et al. |
| 5,804,036 | A | | 9/1998 | Phan et al. |
| 5,820,730 | A | | 10/1998 | Phan et al. |
| 5,853,628 | A | | 12/1998 | Varona |
| 6,017,417 | A | | 1/2000 | Wendt et al. |
| 6,117,270 | A | * | 9/2000 | Trokhan ..... 162/109 |
| 6,136,146 | A | * | 10/2000 | Phan et al. |
| 6,146,496 | A | * | 11/2000 | Phan ..... 162/113 |

FOREIGN PATENT DOCUMENTS

| | | |
|---|---|---|
| EP | 195887 A2 | 10/1986 |
| EP | 367520 A2 | 5/1990 |
| EP | 812952 A2 | 12/1997 |
| JP | 06287883 A | 10/1994 |
| WO | 941577 A1 | 5/1994 |
| WO | 9635018 | 11/1996 |
| WO | WO 0015907 | 3/2000 |

OTHER PUBLICATIONS

International Research Report, filed Jun. 05, 2002.

* cited by examiner

*Primary Examiner*—Peter Chin
(74) *Attorney, Agent, or Firm*—Dority & Manning, P.A.

(57) ABSTRACT

A tissue with two surfaces having elevated regions is provided. The elevated regions can be imparted onto the surfaces of the tissue utilizing various papermaking techniques and devices, such as using patterned fabrics, wire-mesh, and/or pressure rolls. A tissue of the present invention can have a substantial fiber density gradient in the -z direction and a relatively low fiber density gradient in the x-y plane. Moreover, the tissue can also have a substantial pore size distribution gradient in the -z direction and a relatively low pore size distribution gradient in the x-y plane for improved absorption properties.

24 Claims, 5 Drawing Sheets

TISSUE WITH SURFACES HAVING ELEVATED REGIONS

BACKGROUND OF THE INVENTION

Consumers use paper wiping products, such as tissues, for a wide variety of applications. For example, various types of tissues can be used for applications, such as for nose care, cosmetics, eyeglass cleaning, etc. Typically, a user of such tissues requires that the tissues possess a relatively soft feel. Moreover, a user often desires that the tissue be capable of absorbing a certain amount of a liquid without substantially wetting the user's hand during use. In the past, various mechanisms have been utilized to produce tissues having a soft feel. For example, in many cases, a tissue is softened through the application of a chemical additive (i.e., softener) that is capable of enhancing the soft feel of the tissue product. Moreover, in other instances, a side of the tissue is imparted with domes to provide a softer feel.

In the past, domes were typically imparted onto a tissue surface by the application of pressure. For instance, one prior art tissue forming process is described in U.S. Pat. No. 5,556,509 to Trokhan, et al., which is incorporated herein in its entirety by reference thereto. Trokhan describes a process for forming a web by adhering the web to a surface of a heated dryer drum and pressing it between the drum and a roller at a nip to form a web surface with different elevations. Thereafter, the web is creped from the dryer and wound up at a reel. However, one problem with such conventional tissues is that they typically have a "two-sided" feel. Moreover, such conventional tissues also generally have relatively poor absorption properties. For example, a conventional tissue, such as described above, is generally characterized as having relatively high density regions and relatively low regions. Accordingly, these conventional tissues possess a substantial fiber density gradient in the x-y plane (or the plane formed by the machine direction and cross-machine direction), while possessing a relatively low fiber density gradient in the -z direction so that a higher density gradient exists in the x-y plane than in the -z direction.

As a result of such density gradients, the conventional tissues discussed above also have a substantial pore size distribution gradient in the x-y plane and a relatively low pore size distribution gradient in the -z direction so that a higher pore size distribution gradient exists in the x-y plane than in the -z direction. For example, a conventional tissue has large pores formed by the regions and smaller pores formed by the regions. However, because liquids normally flow at a faster rate through larger pores than smaller pores, a user's hand can be easily wetted when using the prior art tissues. Specifically, water can flow readily flow through the pores of the regions onto a user's hand.

As such, a need currently exists for an improved tissue that possesses a soft feel and has good absorption properties.

SUMMARY OF THE INVENTION

The present invention is generally directed to a tissue with surfaces having elevated regions. In particular, a tissue of the present invention includes one surface with one topography and another surface with a different topography.

In general, the present invention is directed to a tissue having "elevated regions" on two surfaces. As used herein, "elevated regions" generally refer to any type of shape imparted onto a tissue surface including, but not limited to, dome, parabola, hyperbola,inverted cone, multiples or combinations thereof or variable contour shapes. In particular, a tissue of the present invention can be provided with two surfaces having elevated regions so that the surfaces have at least one different topographical characteristic, such as a different pitch depth, number (i.e., number of elevated regions in a given area), pitch width, direction, shape, etc.

To form elevated regions onto each tissue surface, a variety of well-known papermaking techniques and devices can be utilized. In particular, devices containing protrusions, such as patterned fabrics, patterned rolls, wire-mesh, etc., can be provided to form elevated regions on the surface of a tissue when contacted therewith. Moreover, various papermaking techniques, such as through-air drying, creping, embossing, calendering, etc., can be utilized when forming the tissue.

In one particular embodiment, for example, the tissue can be formed utilizing a technique known as uncreped through-air drying. In this embodiment, a fibrous web is first deposited onto a forming fabric. From the forming fabric, the web is then transferred to a transfer fabric with the assistance of a vacuum box or shoe, if desired. During this transfer stage (i.e., "rush transfer"), the consistency of the web is typically less than about 35% dry weight, and particularly between about 15% to about 30% dry weight.

In one embodiment, the transfer fabric can also be provided with protrusions, as stated above, to impart elevated regions onto one surface of the tissue. The protrusions of the transfer fabric can generally vary as desired. For example, the transfer fabric can have protrusions of a pitch depth greater than about 0.010 mm, particularly between about 0.025 to about 2 mm, and more particularly between about 1 to about 1.8 mm; and a pitch width greater than about 0.001 mm, particularly between about 0.005 to about 5 mm, and more particularly between about 0.25 mm to about 2.5 mm. In addition, the transfer fabric can also have differing protrusion directions, number per unit area, shapes, etc.

From the transfer fabric, the fibrous web is then transferred to a through-air dryer to substantially dry the web, although other dryers are equally suitable. In some embodiments, for example, the web can be transferred from the transfer fabric to the through-air dryer at a consistency less than about 60% by weight, and particularly between about 25% to about 50% dry weight.

The through-air dryer, in some instances, can also contain a device for imparting elevated regions onto a surface of the tissue. For example, the device can be a wire-mesh surface or a patterned fabric wrapped around the through-air dryer. In one embodiment, a through-air drying fabric can be utilized that has certain protrusions of a pitch depth greater than about 0.010 mm, particularly between about 0.025 to about 2 mm, and more particularly between about 1 to about 1.8 mm; and a pitch width greater than about 0.001 mm, particularly between about 0.005 to about 5 mm, and more particularly between about 0.25 to about 2.5 mm. In addition, the through-air drying fabric can also have differing protrusion directions, number per unit area, shapes, etc.

As stated, in another embodiment, the through-air dryer can contain wire-mesh that also has spaces defined by certain wire protrusions. For instance, in most embodiments, the wire-mesh is formed such that the spaces make up at least about 20% of the overall area of the total wire-mesh surface area. In one embodiment, for example, the wire-mesh surface can contain wire protrusions having a diameter of about 0.029 mm and also spaces defined by the protrusions having an area of about 0.005 $mm^2$.

In some embodiments, other devices, such as a pressure roll, can also be utilized to apply pressure to one or more surfaces of the tissue. For instance, in one embodiment, a pressure roll can press the tissue against the through-air dryer as the tissue travels through a nip. The pressure roll can have a smooth or patterned surface, or can have a smooth or patterned fabric wrapped around the roll. Moreover, in some embodiments, the pressure roll can apply a pressure less than about 60 pounds per square inch (psi), and particularly between about 35 to about 40 psi, to one or more surfaces of the tissue.

As stated, the tissue of the present invention is generally formed with two surfaces having elevated regions. In particular, each surface includes elevated regions having at least one different topographical characteristic, such as, pitch depth, pitch width, number per unit area, direction, etc. For instance, in some embodiments, one surface of the tissue has at least about 50% more elevated regions per square inch than the other surface of the tissue, and particularly between about 50% to about 300%. Further, the pitch depth of the elevated regions of one surface of the tissue, in some embodiments, is between about 20% to about 100% greater than the pitch depth of the elevated regions of the other surface of the tissue.

Moreover, a tissue of the present invention has a substantial fiber density gradient in the -z direction. Further, a tissue of the present invention can also have a relatively low fiber density gradient in the x-y plane so that a higher density gradient exists in the -z direction than in the x-y plane. By providing a tissue with such a fiber density gradient(s), the resulting tissues can have a variety of improved characteristics, such as improved absorbency. In particular, tissues of the present invention can also have a substantial pore size distribution gradient in the -z direction and a relatively low pore size distribution gradient in the x-y plane so that a higher pore size distribution gradient exists in the -z direction than in the x-y plane. For instance, by having a substantial pore size distribution gradient in the -z direction, the tissue can absorb liquids at a slower rate. Further, as a result of having a relatively low pore size distribution density gradient in the x-y plane, the tissue can also act as a liquid transfer barrier for liquid flowing through the tissue.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
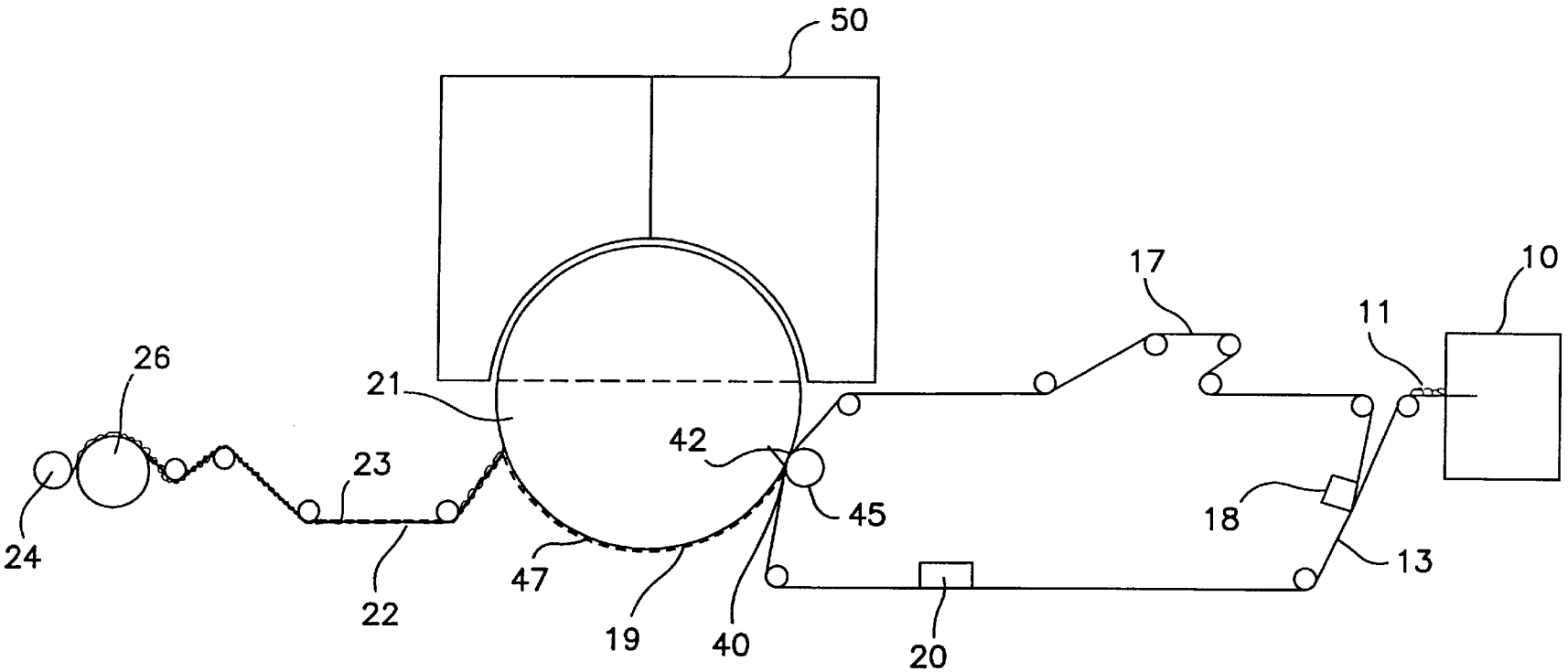
FIG. 1 is schematic diagram of one embodiment for forming elevated regions onto the surfaces of a tissue of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a tissue having "elevated regions" onto two surfaces. For example, a tissue of the present invention can include two surfaces having elevated regions with topographies that differ with respect to at one topographical characteristic, such as pitch depth, number (i.e., number of elevated regions in a given area), pitch width, direction, etc.

In general, any of a variety of tissues or other types of paper webs can be formed with elevated regions in accordance with the present invention. For example, the tissue can be a single or multi-ply tissue. Normally, the basis weight of a tissue of the present invention is less than about 120 grams per square meter (gsm), particularly less than about 60 gsm, particularly from about 10 to about 50 gsm, and more particularly between about 15 to about 35 gsm.

Moreover, a tissue of the present invention can generally be formed from any of a variety of materials. In particular, a variety of natural and/or synthetic fibers can be used. For example, some suitable natural fibers can include, but are not limited to, nonwoody fibers, such as abaca, sabai grass, milkweed floss fibers, pineapple leaf fibers; softwood fibers, such as northern and southern softwood kraft fibers; and hardwood fibers, such as eucalyptus, maple, birch, aspen, and the like. Illustrative examples of other suitable pulps include southern pines, red cedar, hemlock, and black spruce. Exemplary commercially available long pulp fibers suitable for the present invention include those available from Kimberly-Clark Corporation under the trade designations "Longlac-19". In addition, furnishes including recycled fibers may also be utilized. Moreover, some suitable synthetic fibers can include, but are not limited to, hydrophilic synthetic fibers, such as rayon fibers and ethylene vinyl alcohol copolymer fibers, as well as hydrophobic synthetic fibers, such as polyolefin fibers.

In addition, a tissue of the present invention can generally be formed utilizing any of a variety of papermaking processes. In particular, it should be understood that the present invention is not limited to any particular papermaking process. In fact, any process capable of forming a paper web can be utilized in the present invention. For example, a papermaking process of the present invention can utilize creping, embossing, wet-pressing, through-air-drying, creped through-air-drying, uncreped through-air-drying, single recreping, double recreping, calendering, as well as other steps in forming the tissue.

In this regard, one particular embodiment for forming a tissue of the present invention will now be described. Specifically, the embodiment described below relates to one method for forming the tissue of the present invention with elevated regions utilizing a papermaking technique known as uncreped through-drying. Examples of such a technique are disclosed in U.S. Pat. Nos. 5,048,589 to Cook, et al.; 5,399,412 to Sudall, et al.; 5,510,001 to Hermans, et al.; 5,591,309 to Rugowski, et al.; and 6,017,417 to Wendt, et al., which are incorporated herein in their entirety by reference thereto. Uncreped through-air drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

For example, referring to FIG. 1, one embodiment of a papermaking machine that can be used in the present invention is illustrated. For simplicity, the various tensioning rolls schematically used to define the several fabric runs are shown but not numbered. As shown, a papermaking headbox 10 can be used to inject or deposit a stream of an aqueous suspension of papermaking fibers onto a forming fabric 13, which serves to support and carry the newly-formed wet web 11 downstream in the process as the web is partially dewatered to a consistency of about 10 dry weight percent. Additional dewatering of the wet web can be carried out, such as by vacuum suction, while the wet web is supported by the forming fabric. The headbox 10 may be a conventional headbox or may be a stratified headbox capable of producing a multilayered unitary web. Further, multiple headboxes may be used to create a layered structure, as is known in the art.

Forming fabric 13 can generally be made from any suitable porous material, such as metal wires or polymeric filaments. Suitable fabrics can include, but are not limited to, Albany 84M and 94M available from Albany International of Albany, N.Y.; Asten 856, 866, 892, 959, 937 and Asten Synweve Design 274, available from Asten Forming Fabrics, Inc. of Appleton, Wis. The fabric can also be a woven fabric as taught in U.S. Pat. No. 4,529,480 to Trokhan, which is incorporated herein in its entirety by reference thereto. Forming fabrics or felts comprising non-woven base layers may also be useful, including those of Scapa Corporation made with extruded polyurethane foam such as the Spectra Series. Relatively smooth forming fabrics can be used, as well as textured fabrics suitable for imparting texture and basis weight variations to the web. Other suitable fabrics may include Asten 934 and 939, or Lindsey 952-S05 and 2164 fabric from Appleton Mills, Wis.

The wet web 11 is then transferred from the forming fabric 13 to a transfer fabric 17. As used herein, a "transfer fabric" is a fabric which is positioned between the forming section and the drying section of the web manufacturing process. The transfer fabric 17 typically travels at a slower speed than the forming fabric 13 in order to impart increased stretch into the web. The relative speed difference between the two fabrics can be from 0% to about 80%, particularly greater than about 10%, more particularly from about 10% to about 60%, and most particularly from about 10% to about 40%. This is commonly referred to as "rush" transfer. One useful method of performing rush transfer is taught in U.S. Pat. No. 5,667,636 to Engel et al., which is incorporated herein in its entirety by reference thereto.

Transfer may be carried out with the assistance of a vacuum shoe 18 such that the forming fabric 13 and the transfer fabric 17 simultaneously converge and diverge at the leading edge of the vacuum slot. For instance, the vacuum shoe 18 can supply pressure at levels between about 10 to about 25 inches of mercury. The vacuum transfer shoe 18 (negative pressure) can be supplemented or replaced by the use of positive pressure from the opposite side of the web to blow the web onto the next fabric. In some embodiments, other vacuum shoes, such as a vacuum shoe 20, can also be utilized to assist in drawing the fibrous web 11 onto the surface of the transfer fabric 17. During rush transfer, the consistency of the fibrous web 11 can vary. For instance, when assisted by the vacuum shoe 18 at vacuum level of about 10 to about 25 inches of mercury, the consistency of the web 11 may be up to about 35% dry weight, and particularly between about 15% to about 30% dry weight.

Figure 2:
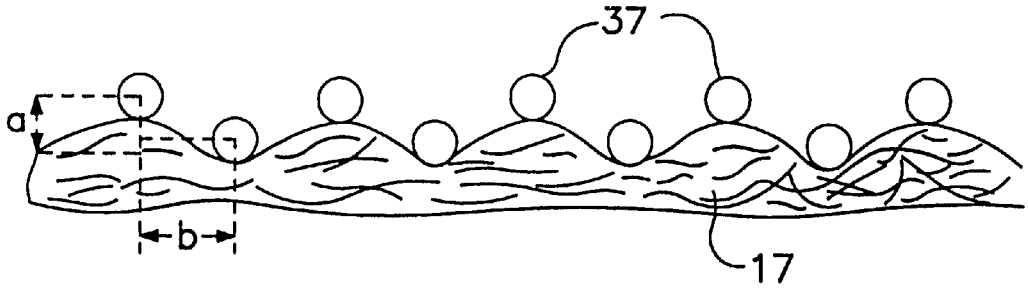
FIG. 2 is a cross-sectional view of one embodiment for forming elevated regions onto a surface of a tissue of the present invention.
Figure 5A:
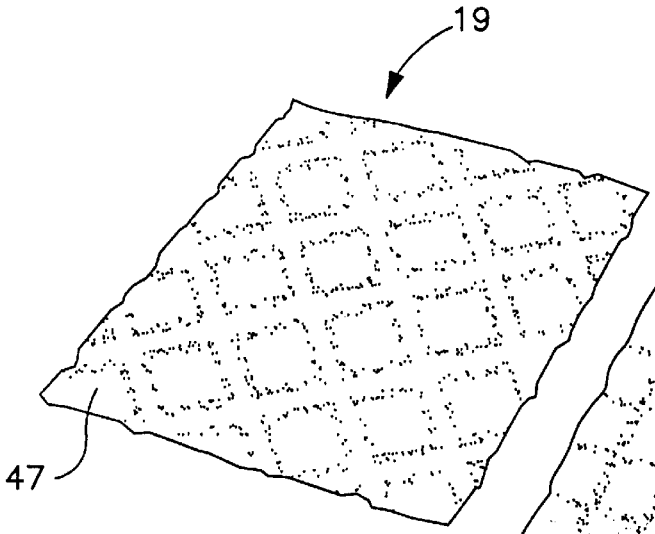
FIG. 5A is a perspective view of a patterned fabric that can be used to form one embodiment of a tissue of the present invention.
Figure 7A:
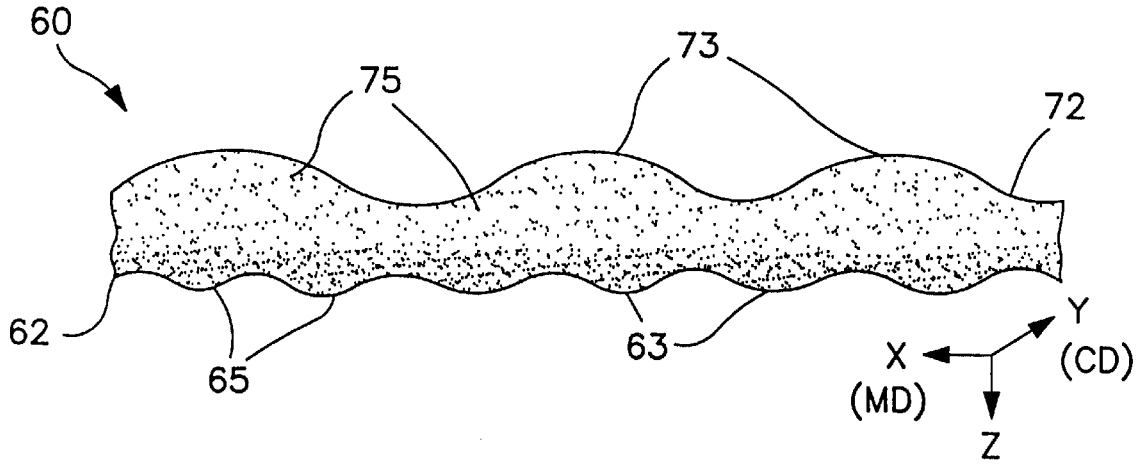
FIG. 7A is a cross-sectional view of the fiber densities of various regions of one embodiment of a tissue of the present invention.
Figure 7B:
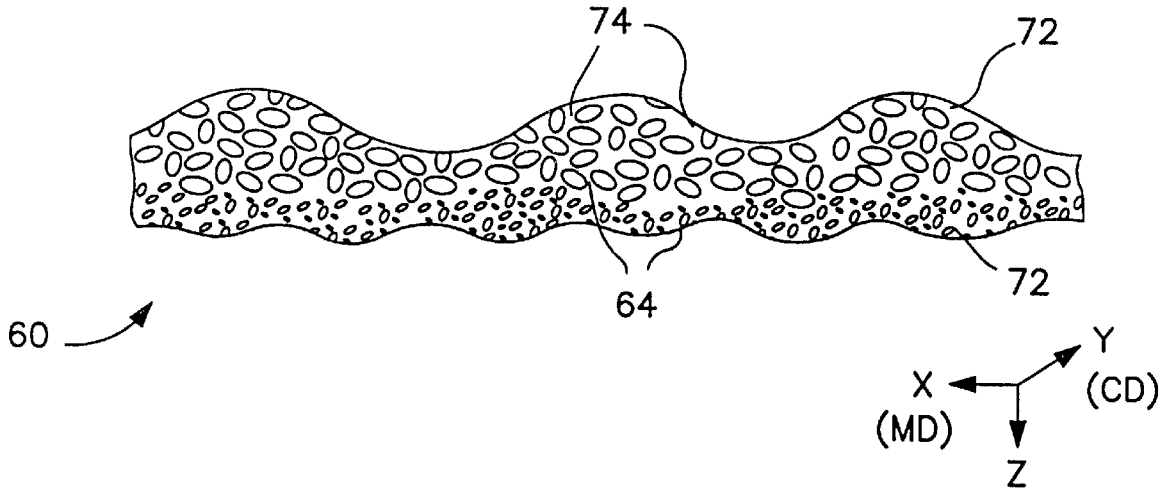
FIG. 7B is a cross-sectional view of the pore size distributions of various regions of one embodiment of a tissue made of the present invention.

Although not required, in some embodiments, the transfer fabric 17 is a patterned fabric having protrusions or impression knuckles, such as described in U.S. Pat. No. 6,017,417 to Wendt et al., which is incorporated herein in its entirety by reference thereto. For instance, referring to FIGS. 2 and 5A, a patterned transfer fabric 17 can have protrusions 37 that allows the fibrous web 11 to be imparted with elevated regions as it is pressed into contact with the transfer fabric 17. Thus, one surface of the fibrous web can be imparted with elevated regions, such as shown in FIGS. 7A–7B.

When utilized, a patterned transfer fabric 17 can generally have any pattern desired. For instance, a pattern for the transfer fabric 17 may imprint the fibrous web 11 with between about 5 to about 300 elevated regions per square inch. Moreover, the protrusions 37 may have a pitch depth "a" greater than about 0.010 mm, particularly between about 0.025 to about 2 mm, and more particularly between about 1 to about 1.8 mm; and a pitch width "b" greater than about 0.001 mm, particularly between about 0.005 to about 5 mm, and more particularly between about 0.25 to about 2.5 mm. In some embodiments, the transfer fabric can have a wire-mesh surface, as is well known in the art. For example, in one embodiment, the transfer fabric has a wire-mesh surface where the wire has a diameter of 1.14 millimeters and a "mesh-count" of 8×13. As used herein, the mesh-count refers to the number of open spaces formed per inch by the wire-mesh in a certain direction. Thus, a mesh-count of 8×13, for example, can refer to a wire-mesh with 8 spaces in length and 13 spaces in width. The transfer fabric 17 can also have protrusions 37 in more than one plane, if desired, to provide elevated regions having differing pitch depths. However, it should be understood that the method of the present invention is not limited to any particular spacing, amount, or size of protrusions 37. In addition, the transfer fabric 17 can also possess protrusions 37 positioned at any desired angle. For instance, the pitch direction of the protrusions can be in the machine direction, or at an angle up to about 45° from the machine direction. However, other angles can be utilized, particularly when forming a tissue having a more complex or irregular surface topology. Moreover, the pitch direction of different protrusions 37 of the transfer fabric 17 can also be positioned at different angles as well.

From the transfer fabric 17, the fibrous web 11 is then transferred to the through-air dryer 21, optionally with the aid of a vacuum transfer shoe 42 or roll. The vacuum transfer roll or shoe 42 (negative pressure) can also be supplemented or replaced by the use of positive pressure from the opposite side of the web to blow the web onto the next fabric. The web 11 is typically transferred from the transfer fabric 17 to the through-air dryer 21 at the nip 40 at a consistency less than about 60% by weight, and particularly between about 25% to about 50% dry weight. In some embodiments, as shown in FIG. 1, a pressure roll 45 can be utilized to press the web 11 against the through-air dryer 21 at a nip 40. The roll 45 can be of made any of a variety of materials, such as of steel, aluminum, magnesium, brass, or hard urethane.

In general, the surface of the pressure roll 45 can vary depending on the characteristics of the papermaking process. In particular, when the "roll side" of the fibrous web 11 is previously imparted with domes by a patterned transfer fabric 17, it may be more desirable that the pressure roll 45 have a smooth surface. As used herein, the "roll side" of the fibrous web refers to the side of the web 11 facing the pressure roll 45 at the nip 40. When utilized, a smooth-surfaced pressure roll 45 can be accomplished in a variety of well-known ways. For example, the pressure roll 45 itself can have a relatively smooth surface. Moreover, in some instances, a relatively smooth fabric can be wrapped around the pressure roll 45.

On the other hand, in some embodiments, the pressure roll 45 can have a patterned surface or be wrapped with a patterned fabric, as is well known in the art. For example, a patterned pressure roll 45 may be utilized to impart elevated regions onto the "roll side" of the fibrous web when the transfer fabric 17 has a smooth surface. However, it should be understood that a patterned pressure roll 45 is not necessarily required.

As stated, the surface of the pressure roll 45, whether smooth or patterned, generally presses the fibrous web 11 against the through-dryer 21 at the nip 40. In general, the pressure roll 45 can press the web 11 against the dryer 21 at a variety of pressures. For instance, in some embodiments, a roll pressure less than about 60 pounds per square inch (psi), and particularly between about 35 to about 40 psi, can be utilized.

Figure 5B:
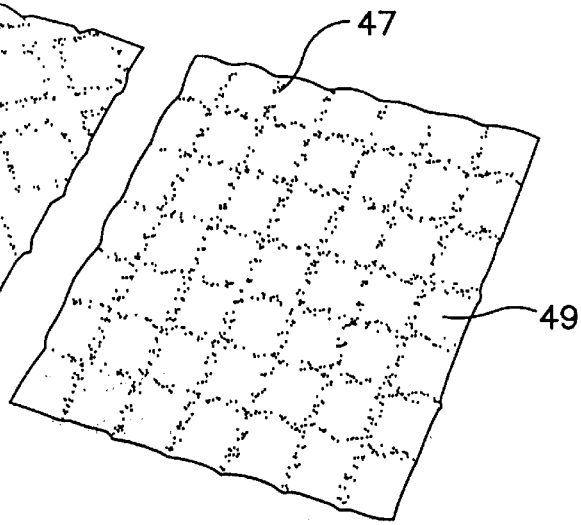
FIG. 5B is a perspective view of wire-mesh that can be used to form one embodiment of a tissue of the present invention.
Figure 6A:
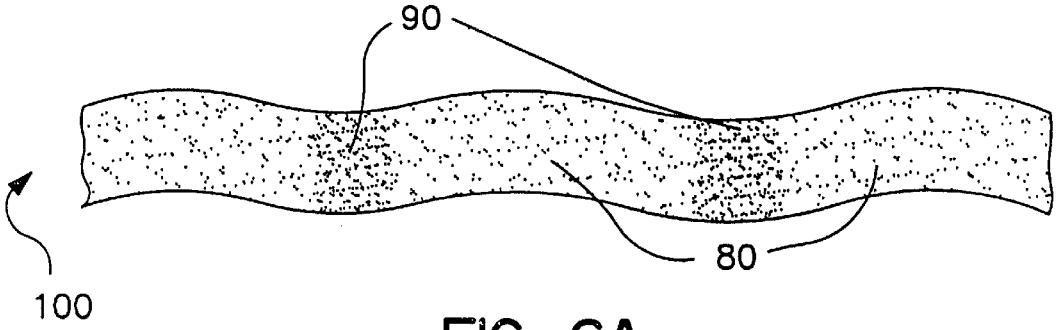
FIG. 6A PRIOR ART
FIG. 6A is a cross-sectional view of the fiber densities of various regions of a prior art tissue.
Figure 6B:
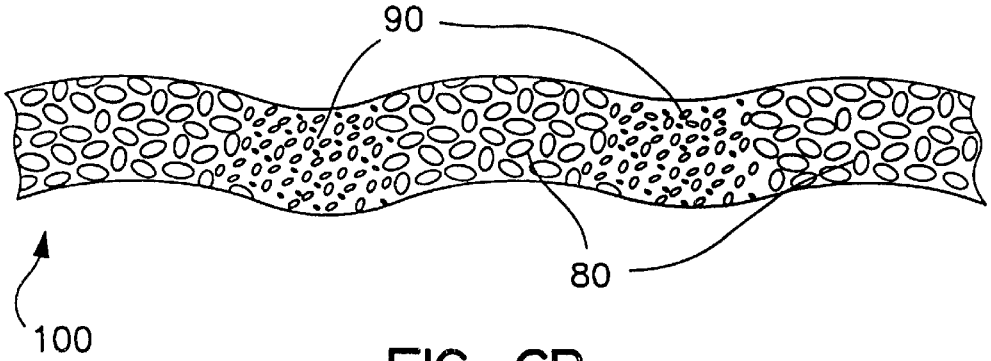
FIG. 6B PRIOR ART
FIG. 6B is a cross-sectional view of the pore size distributions of various regions of the prior art tissue illustrated in FIG. 6A.

In most embodiments, the through-air dryer 21 is provided with a patterned surface to impart domes onto the "dryer side" of the web 11. As opposed to the "roll side", the "dryer side" of the web 11 generally refers to the side of the fibrous web 11 facing the dryer 21 at the nip 40. To impart elevated regions onto the dryer side of the web 11, a patterned surface for the through-air dryer 21 can be provided in a variety of ways. For instance, in some embodiments, the through-air dryer 21 can be formed with a wire-mesh surface, such as well known in the art, to impart a surface with elevated regions onto the "dryer side" of the web. In one particular embodiment, for example, as shown in FIG. 5B, the through-air dryer 21 has a wire-mesh surface in which the wire 47 has a diameter of about 0.029 mm and the spaces 49 defined by the wire have an area of about 0.005 $mm^2$. In another embodiment, the wire 47 has a diameter of about 1 mm and a mesh-count of 4×4. Moreover, in most embodiments, the wire-mesh is formed such that the open spaces 49 make up at least about 20% of the overall area of the total wire-mesh surface area. It should be understood, however, that wire-mesh surfaces of a variety of sizes may be suitable for use in the present invention.

Figure 3:
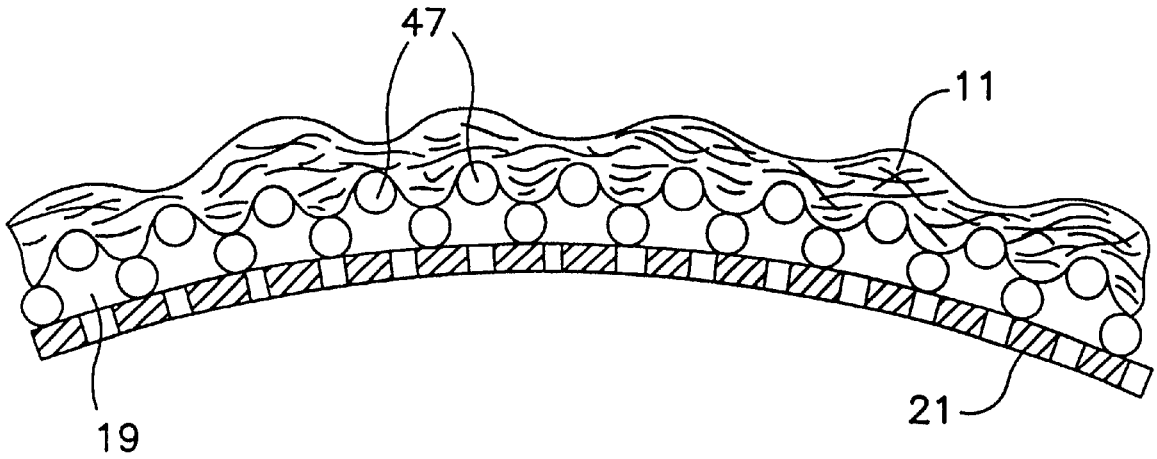
FIG. 3 is a cross-sectional view of another embodiment for forming elevated regions onto a surface of a tissue of the present invention.
Figure 4:
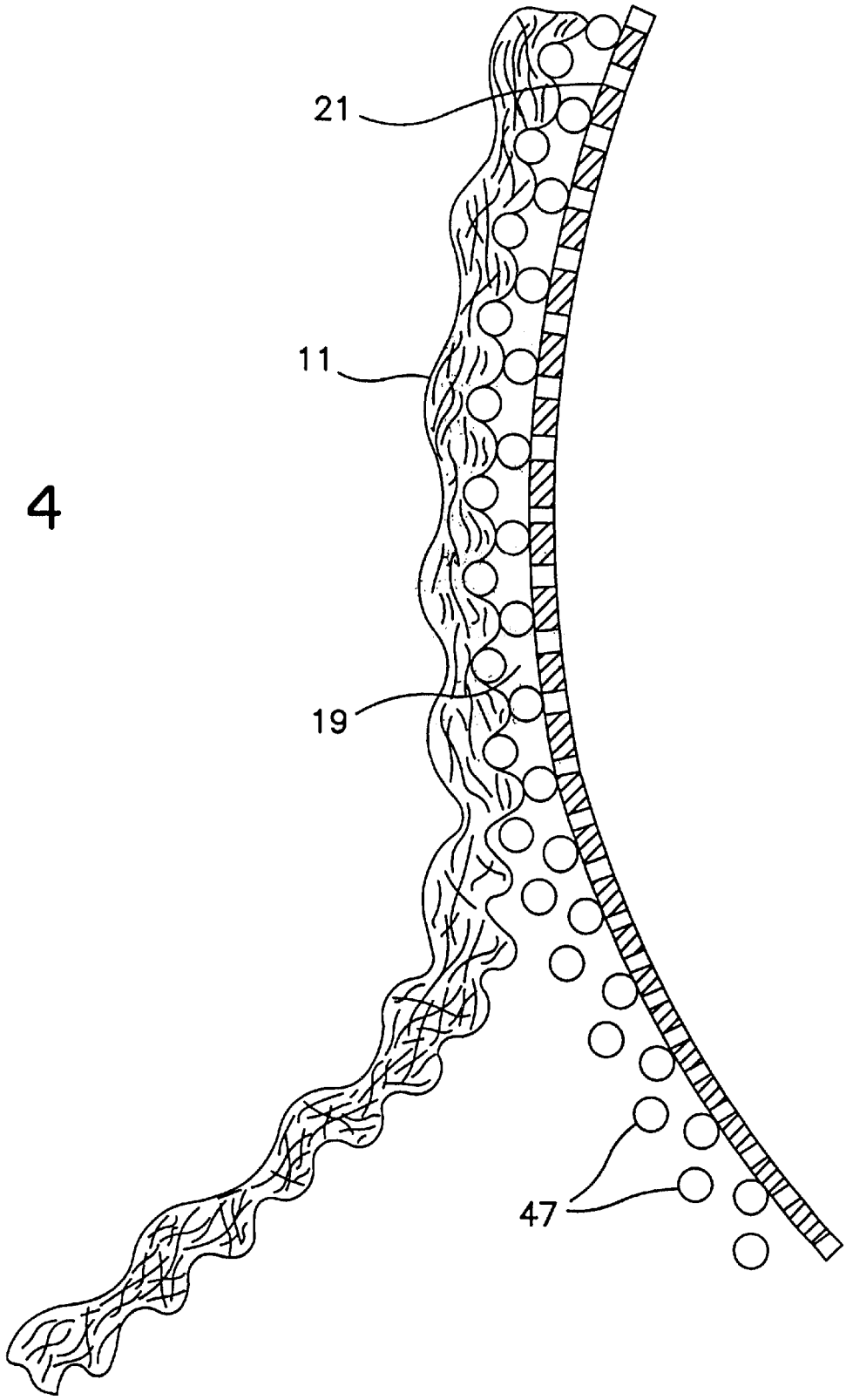
FIG. 4 is another cross-sectional view of the embodiment illustrated in FIG. 3.

In other embodiments, the through-air dryer 21 may also be provided with a through-air drying fabric 19, such as depicted in FIGS. 1 and 3–4. The through-air drying fabric 19 can travel at about the same speed or a different speed relative to the transfer fabric 17. For example, if desired, the through-air drying fabric 19 can run at a slower speed to further enhance stretch.

As stated, when utilized, the through-air drying fabric 19 is typically provided with various protrusions or impression knuckles to impart a surface with elevated regions onto the "dryer side" of the fibrous web. Some examples of such fabrics are described in U.S. Pat. No. 6,017,417 to Wendt et al. The through-air drying fabric 19 may be woven or nonwoven. In general, the patterned through-air drying fabric 19 can have any pattern desired. For instance, protrusions 47 of the through-air drying fabric 19 may imprint the fibrous web 11 with between about 5 to about 300 elevated regions per square inch. Moreover, the protrusions 47 may have a pitch depth "a" greater than about 0.010 mm, particularly between about 0.025 to about 2 mm, and more particularly between about 1 to about 1.8 mm; and a pitch width "b" greater than about 0.001 mm, particularly between about 0.005 to about 5 mm, and more particularly between about 0.25 to about 2.5 mm. The through-air drying fabric 19 can also have protrusions 47 in more than one plane, if desired, to provide elevated regions having differing pitch depths. However, it should be understood that the method of the present invention is not limited to any particular number or size of protrusions 47.

In addition, the through-air drying fabricl9 can also possess protrusions 47 positioned at any desired angle. For instance, the pitch direction of the protrusions 47 can be in the machine direction, or at an angle up to about 45° from the machine direction. However, other angles can be utilized, particularly when forming a tissue having a more complex or irregular surface topography. Moreover, the pitch direction of different protrusions 47of the through-air drying fabric 19 can also be positioned at different angles as well.Regardless of the mechanism utilized, the "dryer side" of the fibrous web 11 is generally provided with a different pattern of elevated regions than the "roll side". Thus, for example, in one embodiment of the present invention, the pressure roll 45 simultaneously presses the fibrous web 11 into contact with the transfer fabric 17 and the through-air drying fabric 19 at the nip 40. The transfer fabric 17 has a first pattern of protrusions 37 and imparts the "roll side" of the web 11 with a first pattern of elevated regions, while the through-air drying fabric 19 has a second pattern of protrusions 47 and imparts the "dryer side" of the web 11 with a second pattern of elevated regions.

Once the pressure roll 45 impresses the fibrous web 11 against the through-air dryer 21, the through-air dryer 21 can then accomplish the removal of moisture from the web 11 by passing air through the web without applying any mechanical pressure. Through-air drying can also increase the bulk and softness of the web. In one embodiment, for example, the through-dryer can contain a rotatable, perforated cylinder and a hood 50 for receiving hot air blown through perforations of the cylinder as the through-air drying fabric 19 carries the fibrous web 11 over the upper portion of the cylinder. The heated air is forced through the perforations in the cylinder of the through-air dryer 21 and removes the remaining water from the fibrous web 11. The temperature of the air forced through the fibrous web 11 by the through-air dryer 21 can vary, but is typically from about 250° F. to about 500° F. It should also be understood that other non-compressive drying methods, such as microwave or infrared heating, can be used. Moreover, if desired, certain compressive heating methods, such as Yankee dryers, may be used as well.

While supported by the through-air drying fabric 19, the web can then be dried to a consistency of about 95 percent or greater by the through-air dryer 21 and thereafter transferred to a carrier fabric 22. The dried basesheet 23 having two sides with elevated regions is then transported to from the carrier fabric 22 to a reel 24, where it is wound. An optional turning roll 26 can be used to facilitate transfer of the web from the carrier fabric 22 to the reel 24.

It should be understood that the process described above is but one method for forming a tissue having elevated regions in accordance with the present invention. As stated, other well-known papermaking steps, such as creping, etc., may also be utilized in the present invention. Moreover, the process of forming the tissue of the present invention is also not limited to the employment of the above-mentioned devices for imparting elevated regions onto a surface of a tissue (e.g., transfer fabrics, pressure rolls, through-air drying fabrics, etc.). In fact, other devices, such as other fabrics, rolls, and the like, may be employed to impart the desired elevated regions.

By providing each surface of a tissue with elevated regions, it has been discovered that the tissue can have a variety of improved characteristics, such as improved softness and absorbency. For instance, because the tissue has relatively lightly bonded elevated regions on each surface, each side of the tissue typically has a soft feel.

Furthermore, a tissue of the present invention also possesses a variety of other advantageous properties. For instance, the surfaces of the tissue can increase the absorption rate of a liquid and/or act as a barrier to liquid transfer through the tissue. In particular, a tissue of the present invention can generally have a relatively low fiber density gradient in the x-y (or machine direction) plane, while also having a substantial fiber density gradient in the -z direction so that a higher density gradient exists in the -z direction than in the x-y plane. In particular, each tissue surface is imparted with elevated regions having different topographical characteristics, such as different depths, widths, direction, number of elevated regions per unit area, etc. For instance, in some embodiments, one surface of the tissue has at least about 50% more elevated regions per square inch than the other surface of the tissue, and particularly between about 50% to about 300%. Further, the pitch depth of the elevated regions of one surface of the tissue.

Referring to FIGS. 7A–7B, for example, one embodiment of a single ply tissue 60 of the present invention is illustrated. As shown, the tissue 60 has a first surface 62 with elevated regions 63 and a second surface 72 with elevated regions 73 such that the first surface 62 has at least one different topographical characteristic than the second surface 72. Specifically, in this embodiment, the number (i.e., elevated regions per square inch) of elevated regions 73 is less than the number of elevations 63, while the elevated regions 73 have a greater pitch width and depth than the elevated regions 63. Due to their smaller number per square inch and greater size, the elevated regions 73 typically-contain fibers 75 that maintain a relatively larger distance from each other. As a result, less hydrogen bonds are likely to form between the fibers, and consequently, the elevated regions 73 tend to have a relatively lower fiber density. On the other hand, the elevated regions 63 typically contain fibers that tend to maintain a relatively shorter distance from each other. Thus, the elevated regions 63 of the first surface 62 tend to have a higher fiber density than the elevated regions 73 of the second surface 72. Accordingly, tissues made in accordance with the present invention have a substantial fiber density gradient in the -z direction (i.e., a decreasing fiber density gradient from the first surfase 62 to the second surface 72).

In addition, as stated above, the tissues of the present invention also have a relatively low fiber density gradient in the x-y plane. For example, referring again to FIG. 7A, the fiber densities of the first surface 62 and the second surface 72 do not substantially change in the x-y plane. In particular, it is believed that the use of elevated regions on each surface of the tissue causes much of the fiber compression to occur near the smaller elevated regions 63 of the first surface 62, rather than the larger elevated regions 73 of the second surface 72. Thus, although the fiber densities in the x-y plane may vary somewhat for one surface (i.e., vary from the portions of the surface impressed between protrusions and portions of the surface forming the elevated regions), the fiber densities in the x-y plane do not substantially change, such as in conventional tissues.

By providing a substantial fiber density gradient in the -z direction and a relatively low fiber density gradient in the x-y plane, the resulting tissue can have a variety of improved characteristics, such as improved absorbency. In particular, an elevated region with less hydrogen bonding between fibers generally possesses a greater pore size distribution than an elevated region with more hydrogen bonding between fibers. For example, referring to FIG. 7B, the larger elevated regions 73 of the second surface 72 have pores 74 with a certain area. In contrast, the smaller elevated regions 63 of the first surface 62 have pores 64 that are generally smaller in area than the pores 74. As a result, tissues of the present invention typically have a substantial pore size distribution gradient in the -z direction (i.e., an increasing pore size distribution gradient from the first surface 62 to the second surface 72) and a relatively low pore size distribution gradientin the x-y plane so that a higher pore size distribution gradient exists in the -z direction than in the x-y plane. Because tissues of the present invention have such a pore size distribution gradient in the -z direction, for example, it is believed that a capillary affect can occur that causes a liquid traveling therethrough to flow more readily through the larger pores than the smaller pores. The smaller pores act as vacuum to attract liquid from the larger pores, an which thus increases the rate of absorption of the liquid from the tissue surface. Moreover, because the liquid flows at a slower rate through the smaller pores, the liquid tends to reside in the smaller pores for a longer period of time. Further, as a result of having a relatively low pore size distribution gradient in the x-y plane, the liquid can disperse from certain smaller pores to other smaller pores in the x-y plane. As a result, the smaller pores can often act as a liquid transfer barrier for liquid flowing through the tissue.

For instance, referring to FIG. 7B, a tissue of the present invention can have larger pores 74 and smaller pores 64. As a liquid contacts the second surface having larger pores 74, it quickly flows therethrough. Once the liquid flows through the larger pores, it then contacts the smaller pores 64 and is dispersed in the x-y plane. As a result, the absorption rate of the liquid is increased by one tissue surface, while a liquid transfer barrier for keeping the hands of a user relatively dry is provided by the other tissue surface. In other embodiments, the liquid may also first contact the first surface 62 having smaller pores 64. In such instances, the first surface 62 can still act as a liquid transfer barrier for keeping the hands of a user relatively dry.

It should be understood that a tissue of the present invention can be a single- or multi-ply tissue. When utilizing multi-ply tissues, one or more of the plies may be formed in accordance with the present invention. Moreover, in some instances, only the outer surfaces of the multi-ply tissue may be imparted with elevated regions. For instance, in one embodiment, a two-ply tissue can be formed. The first ply can have one surface with elevated regions and another surface with non-elevated regions. The second ply can also have one surface with elevated regions and another surface with non-elevated regions. The non-elevated surface of the first ply can then be placed adjacent to the non-elevated surface of the second ply to form a multi-ply tissue having two surfaces with elevated regions.

In some instances, a multi-ply tissue made according to the present invention can be particularly useful to consumers. In particular, consumers often use more than one tissue at once. Thus, when the outer surface of each outer ply is formed with elevated regions in accordance with the present invention, the liquid tends to flow along the x-y instead of in the z-direction. As a result, the time required for liquid transfer through the tissue is increased. This provides a unique benefit in that a consumer's hand can be protected without loosing the tissue liquid absorbent capability.

In addition to the benefits and advantages discussed above, a tissue of the present invention can also have a variety of other benefits as well. For instance, a tissue having elevated regions on each surface can increase the caliper of the tissue, which allows for the use of smaller elevated regions (e.g., smaller pitch depth or width) to provide a desired sheet thickness. Moreover, because each surface of the tissue possesses some hydrogen bonding, lint and slough may also be reduced.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. tissue product defining a first surface and a second surface, said first surface of said tissue product having first elevated regions forming a first topography and said second surface of said tissue product having second elevated regions forming a second topography, wherein said second surface is imparted with at least about 50% more elevated regions per square inch than said first surface, said first elevated regions having a pitch depth of from about 20% to about 100% greater than the pitch depth of said second elevated regions, wherein a decreasing fiber density gradient is formed in the -z direction from said second outer surface to said first surface.

2. A tissue product as defined in claim 1, wherein said second surface is imparted with from about 50% to about 300% more elevated regions per square inch than said first surface.

3. A tissue product as defined in claim 1, wherein said tissue product has a higher pore size distribution gradient in the -z direction than in the x-y plane.

4. A tissue product as defined in claim 1, wherein said fibers contain pulp fibers.

5. A tissue product as defined in claim 1, wherein said tissue product has a basis weight less than about 120 grams per square meter.

6. A tissue product as defined in claim 1, wherein said tissue product has a basis weight less than about 60 grams.

7. A tissue product as defined in claim 1, wherein said tissue product contains multiple plies.

8. A tissue product as defined in claim 7, wherein one ply defines said first surface, and another ply defines said second surface.

9. A tissue product as defined in claim 7, wherein one ply defines said first surface and said second surface.

10. A tissue product as defined in claim 1, wherein the fiber density of said first and second elevated regions is relatively constant in the x-y plane of the tissue product.

11. A tissue product as defined in claim 1, wherein an increasing pore size gradient is formed in the -z direction from said second surface to,said first surface.

12. A tissue product as defined in claim 1, wherein the pore size distribution of said first and said second elevated regions is relatively-constant in the x-y plane.

13. A tissue product comprising:

a fibrous web containing pulp fibers having a first surface and a second surface, said first surface of said fibrous web having first elevated regions forming a first topography, said second surface of said fibrous web having second elevated regions forming a second topography, wherein said second surface is imparted with at least about 50% more elevated regions per square inch than said first surface, said first elevated regions having a pitch depth of from about 20% to about 100% greater than the pitch depth of said second elevated regions, wherein an increasing pore size gradient is formed in the -z direction from said second surface to said first surface.

14. A tissue product as defined in claim 13, wherein said second surface is imparted with from about 50% to about 300% more elevated regions per square inch than said first surface.

15. A tissue product as defined in claim 13, wherein a decreasing fiber density gradient is formed in the -z direction from said second surface of said fibrous web to said first surface of said fibrous web.

16. A tissue product as defined in claim 13, wherein the fiber density of said first and second elevated regions is relatively constant in the x-y plane of the tissue product.

17. A tissue product as defined in claim 13, wherein the pore size distribution of said first and second elevated regions is relatively constant in the x-y plane of the tissue product.

18. A tissue product as defined in claim 13, wherein said tissue product contains multiple plies, wherein one of said plies comprises said fibrous web such that an outer surface of said tissue product is formed by said first surface of said fibrous web.

19. A tissue product as defined in claim 18, further comprising a second fibrous web containing pulp fibers having a first surface and a second surface, said first surface of said second fibrous web having third elevated regions forming a third topography, said second surface of said second fibrous web having fourth elevated regions forming a fourth topography, wherein said second surface of said second fibrous web is imparted with at least about 50% more elevated regions per square inch than said first surface of said second fibrous web such that an increasing pore size gradient is formed in the -z direction from said second surface of said second fibrous web to said first surface of said second fibrous web.

20. A tissue product as defined in claim 19, wherein another one of said plies comprises said second fibrous web such that the other outer surface of said tissue product is formed by said first surface of said second fibrous web.

21. A tissue product as defined in claim 19, wherein a decreasing fiber density gradient is formed in the -z direction from said second surface of said second fibrous web to said first surface of said second fibrous web.

22. A tissue product as defined in claim 19, wherein the fiber density of said third and fourth elevated regions is relatively constant in the x-y plane of the tissue product.

23. A tissue product as defined in claim 19, wherein the pore size distribution of said third and fourth elevated regions is relatively constant in the x-y plane of the tissue product.

24. A tissue product defining a first surface and a second surface, said first surface of said tissue product having first elevated regions forming a first topography and said second surface of said tissue product having second elevated regions forming a second topography, wherein said second surface is imparted with from about 50% to about 300% more elevated regions per square inch than said first surface, said first elevated regions having a pitch depth of from about 20% to about 100% greater than the pitch depth of said second elevated regions, wherein a decreasing fiber density gradient and an increasing pore sizegradient is formed in the -z direction from said second surface to said first surface, wherein the fiber density gradient and pore size distribution of said first and second elevated regions is relatively constant in the x-y plane of the tissue product.

* * * * *

UNITED STATES PATENT AND TRADEMARK OFFICE

CERTIFICATE OF CORRECTION

PATENT NO. : 6,464,829 B1
APPLICATION NO. : 09/641355
DATED : October 15, 2002
INVENTOR(S) : Chen et al.

It is certified that error appears in the above-identified patent and that said Letters Patent is hereby corrected as shown below:

Column 11, line 39, " tissue product defining a first surface and a second" should read --A tissue product defining a first surface and a second--

Signed and Sealed this

Eighth Day of August, 2006

JON W. DUDAS
*Director of the United States Patent and Trademark Office*